United States Patent [19]

Phillips et al.

[11] Patent Number: 4,571,595

[45] Date of Patent: Feb. 18, 1986

[54] DUAL BAND TRANSCEIVER ANTENNA

[75] Inventors: James P. Phillips, Lake in the Hills; Henry L. Kazecki, Chicago, both of Ill.

[73] Assignee: Motorola, Inc., Schaumburg, Ill.

[21] Appl. No.: 558,270

[22] Filed: Dec. 5, 1983

[51] Int. Cl.[4] ..... H01Q 9/16; H01Q 1/24

[52] U.S. Cl. ..... 343/745; 343/749; 343/702; 343/845

[58] Field of Search ..... 343/702, 718, 806, 802, 343/748–751, 845, 846, 848, 850, 852, 858, 828–831, 745, 747, 861, 862; 361/412, 413; 455/349, 269, 193

[56] References Cited

U.S. PATENT DOCUMENTS

| | | | |
|---|---|---|---|
| 2,514,992 | 7/1950 | Edelsohn | 343/803 |
| 2,759,183 | 8/1956 | Woodward | 343/806 |
| 3,465,344 | 9/1969 | Scott et al. | 343/852 |
| 3,573,628 | 4/1971 | Cramer et al. | 343/702 |
| 3,946,392 | 3/1976 | Whitman | 343/845 |
| 3,956,701 | 5/1976 | James, Jr. et al. | 343/702 |
| 4,095,229 | 6/1978 | Elliott | 343/852 |
| 4,307,438 | 12/1981 | Grubb | 361/413 |
| 4,388,672 | 6/1983 | Skill | 361/412 |
| 4,471,493 | 9/1984 | Schober | 343/702 |

*Primary Examiner*—Eli Lieberman
*Assistant Examiner*—Michael C. Wimer
*Attorney, Agent, or Firm*—Margaret M. Parker

[57] ABSTRACT

A dual band antenna for a radio transceiver includes an inductively loaded conductor of a predetermined length with feedpoint located substantially central of the conductor. Radiator elements terminate the ends of the conductor and a ground plane terminates the radiator elements. An adjustable balanced impedance matching circuit is coupled to the feedpoint. Dual banding elements couple to the impedance matching circuit with a high Q, parallel resonant circuit element. Input and output circuits are also coupled to the dual banding elements. The design minimizes the effect on the antenna operation by the proximity of the user's hands and head since the high impedance portion of the antenna is confined to the center thereof.

7 Claims, 5 Drawing Figures

DUAL BAND TRANSCEIVER ANTENNA

BACKGROUND OF THE INVENTION

This invention relates to an improved dual bank antenna. The invention allows the antenna to function with a radio wave transceiver in applications where the antenna must be compact and yet not be affected by the operator during use.

Portable radio equipment often uses electrically small or compact antennas which are located within the equipment housing. These prior antennas are subject to detuning and excessive loss which often occur when a high impedance part of the antenna is subject to close approach by the operator's hand or body. For example, short electric dipole or electric monopole antennas have the high impedance areas near the ends of the conductors, often the part of the antenna most exposed to interference by the operator's hand or body.

Another problem encountered by small or compact antennas is that the antenna gain varies inversely wtih the bandwidth. Increasing the gain decreases the bandwidth which significantly reduces the capability to transmit and receive signals. For example, loop antennas have a very narrow bandwidth and only a slight detuning will cause excessive loss, making the antenna highly inefficient.

Antennas for a miniature radio transceiver are known. One such an antenna having a low profile loop antenna structure for use when the radio is mounted on the operator's body and a high efficiency dipole antenna for use when the radio is held in the operator's hand is described in U.S. Pat. No. 4,313,119 to Oscar M. Garay and Kazimierz Siwiak, and assigned to Motorola, Inc., the assignee of the present invention. While that dual mode antenna is highly satisfactory for use with a two-way miniature radio or talk-back pager of the type worn on the body of a person, it is less satisfactory for use as portable radio equipment, such as cordless telephones.

It is therefore a general object of the present invention to provide a new and improved dual band transceiver antenna.

It is a further object of the present invention to provide such an antenna which is inductively loaded to be constructed in a compact size and promote high efficiency.

It is another object of the invention to provide an antenna which can be easily manufactured or fabricated using printed circuit techniques to produce the conductor pattern of the antenna.

It is still another object of the invention to provide an antenna with the high impedance field in the center of the antenna to minimize the detrimental effect that an operator can have upon the radio's performance.

It is a still further object of the invention to provide an improved antenna for a miniaturized transceiver including, a high Q parallel tuned circuit whereby said circuit "dual bands" the antenna.

It is still another object of the invention to provide an improved antenna for a compact transceiver wherein the antenna may be tuned to an exact frequency by a variable capacitor.

SUMMARY OF THE INVENTION

The invention provides a dual band antenna for a radio wave transceiver which includes an inductively loaded antenna having a conductor of a predetermined length for radiating an electric signal therealong. A feed point is located substantially central to the ends of the conductor. Radiator elements terminate the ends of the conductor. A ground plane terminates the radiator elements. An impedance matching circuit is coupled to the feed point whereby the high impedance part is confined to the center of the antenna. The antenna also includes dual banding means for providing two frequencies. The dual banding means couple the impedance matching circuit with a high, parallel-tuned resonant circuit. Input means are coupled to the dual banding means.

More specifically the present invention provides an improved antenna for a radio wave transceiver which includes an elongated circuit board having longitudinal and transverse axes and a second circuit board connected to the upper portion of the elongated circuit board in a substantially perpendicular position. The antenna conductor is supported on the second circuit board and extends across the transverse axis of the elongated circuit board. The radiator elements which terminate the ends of the antenna conductor extend parallel to the longitudinal axis of the elongated circuit board. A ground plane terminates the radiator elements and extends substantially parallel to the longitudinal axis of the elongated circuit board. An antenna duplexer is coupled to the dual banding means.

DESCRIPTION OF THE PREFERRED EMBODIMENTS

Figure 1:
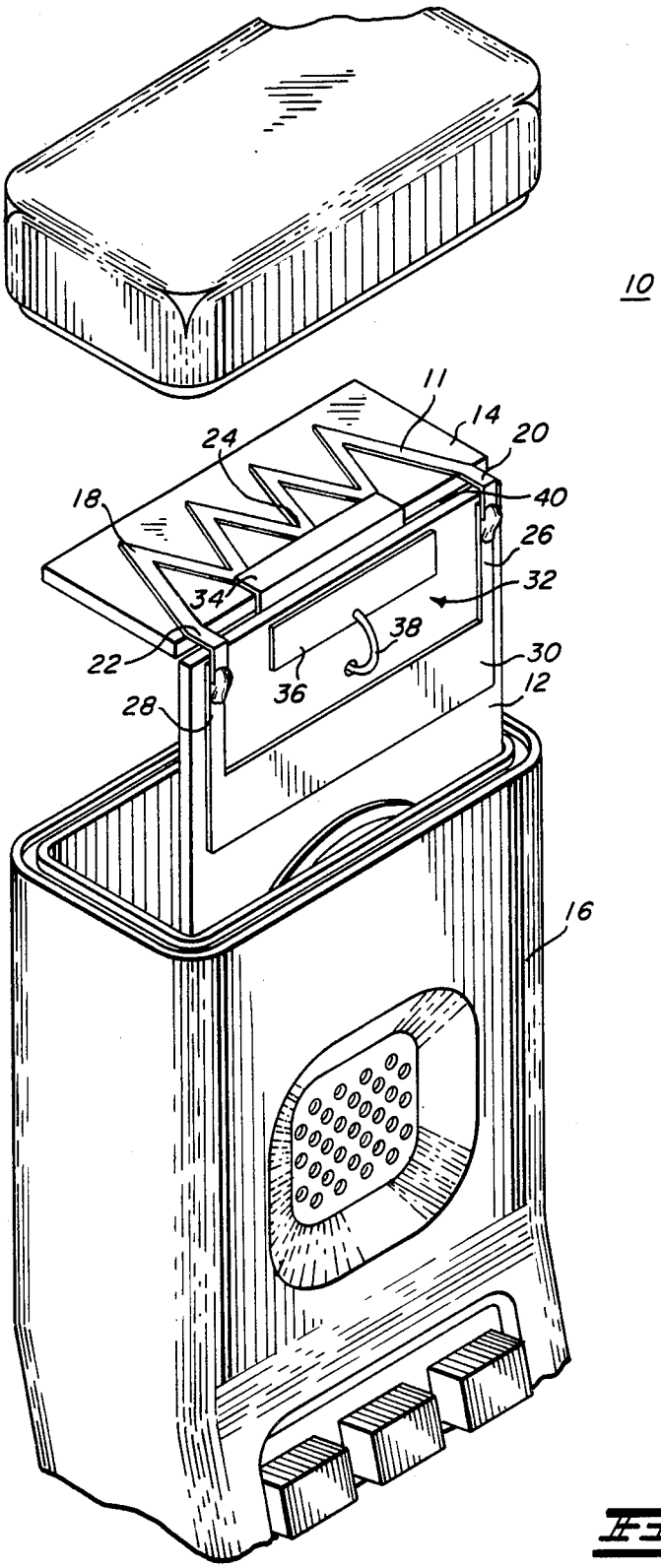
FIG. 1 is an exploded perspective view illustrating a compact radio transceiver having an antenna in accordance with the present invention.

Referring now to FIG. 1, a compact radio wave transceiver 10 having an improved antenna 11 is illustrated. The transceiver 10 includes an elongated circuit board 12 having longitudinal and transverse axes. Connected to the upper portion of the elongated circuit board is a second circuit board 14 which is in a substantially perpendicular position. A housing 16 encases the elongated circuit board 12 and the second circuit board 14 and contains the accessories normally found with a cordless phone handset, shown here for exemplary reasons.

The second circuit board 14 includes a conductor 18 of a predetermined length and having first and second ends 20, 22 spaced apart from each other. A feed point 24 is located substantially in the center of the conductor 18. The configuration of the conductor 18 illustrated in FIG. 1 is that of a sawtooth pattern but other configurations are possible.

The first and second ends 20, 22 of the conductor pattern terminate with first and second radiator elements 26, 28, respectively. The radiator elements 26, 28 extend substantially parallel to the longitudinal axis of the elongated circuit board 12 and then terminate with a ground plane 30. The ground plane is positioned on the elongated circuit board. The elongated and second circuit boards are made of a material which is nonconducting whereas the ground plane is made of a conducting element such as a metal plate.

Preferably, the conductor pattern 18 of the antenna 11 is printed on a conventional dielectric substrate using the same techniques which are used for printed circuits. Such an antenna is easily and inexpensively manufactured, yet compact in size. Subsequent to the manufacture of the antenna, one need only connect the radiator elements 26, 28 and the feed point 24 to the conductor pattern 18.

Coupled to the feed point 24 of the antenna 11 is an impedance matching circuit 32 including a variable capacitor. This center point coupling confines the high impedance part of the antenna 11 to the center thereof. Other variable capacitor means also may be used. For ease of manufacture, it is preferred that an air gap parallel plate device be used where a first conducting plate 34 is connected plate 36 is spaced apart from the first conducting to the antenna 11 and a second conducting plate 34 and connected to an input transmission line 38. An air gap 40 may be at least partially filled by a dielectric material, which is illustrated as a portion of the elongated circuit board 12.

Figure 2:
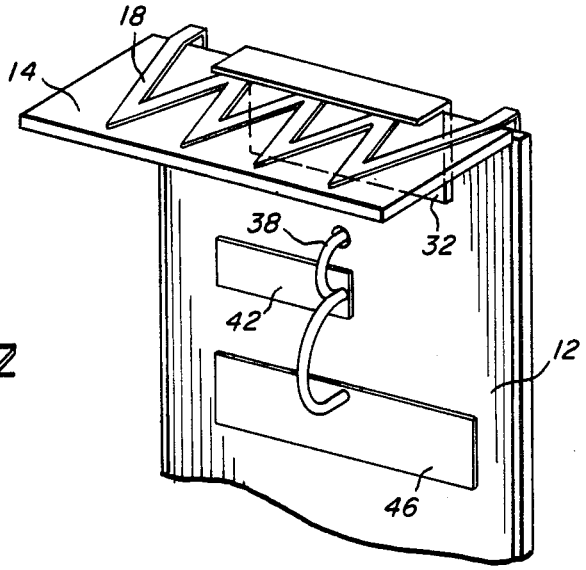
FIG. 2 is a perspective view illustrating the reverse side of a portion of FIG. 1.

Referring now to FIG. 2, the input transmission line 38 leads through the elongated circuit board 12 to couple the second conducting plate 36 with a high Q circuit element 42. Other dual banding means for providing two frequency bands are possible but must also be parallel tuned circuits It is preferred that the two frequency bands be about 1 MHz in bandwidth and spaced apart by about 1 to 8 percent of a center frequency.

Figure 3:
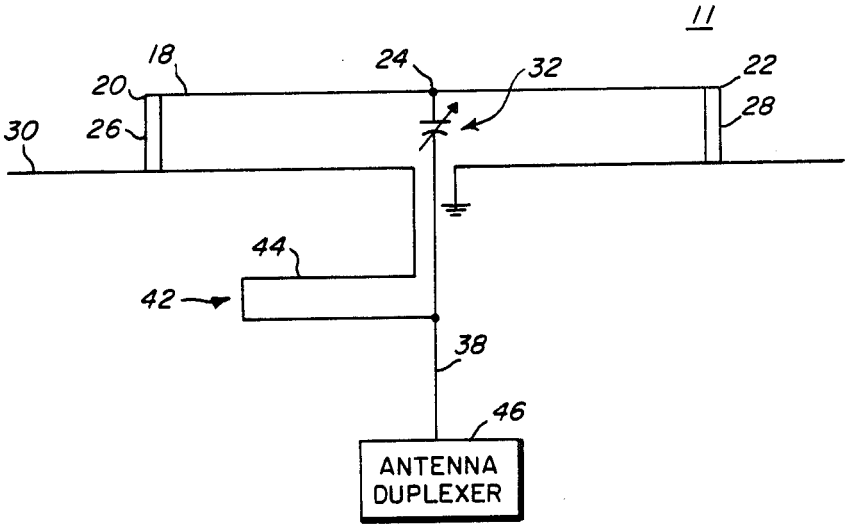
FIG. 3 is a circuit diagram of the present invention.

Referring to FIG. 3, a circuit diagram further illustrates the function of the components comprising the present invention. The dual band antenna 11 includes the conductor 18 of and feed point 24 is located substantially central thereto. Radiator elements 26, 28 are coupled to the ends 20, 22 of the conductor 18. The ground plane 30 terminates the radiator elements.

The impedance matching circuit 32, illustrated as a variable capacitor but including the inductive reactive of the conductor 18, is coupled to the feed point 24 to develop a high impedance in the center of the antenna in order to minimize the detrimental effect that an operator's person can have on performance of the antenna 11.

The variable capacitor 32 is used to tune the antenna 11 to an exact frequency Coupled to the variable capacitor 32 are dual banding means for providing two closely adjacent frequency bands. The dual banding means include a high Q circuit element, generally 42, which simulates a parallel tuned circuit. The parallel tuned circuit is a transmission line stub 44 pretuned to frequency by adjusting the length of a pair of spaced conductors (not shown).

The input transmission line 38 is connected to a duplexer 46. The duplexer 46 may then be connected to a transmitter and data entry device (not shown) such as a keyboard or microphone. The duplexer 46 also may be connected to a receiver or output device such as a speaker (not shown). Other input and output devices are also possible with the present invention.

Figure 4:
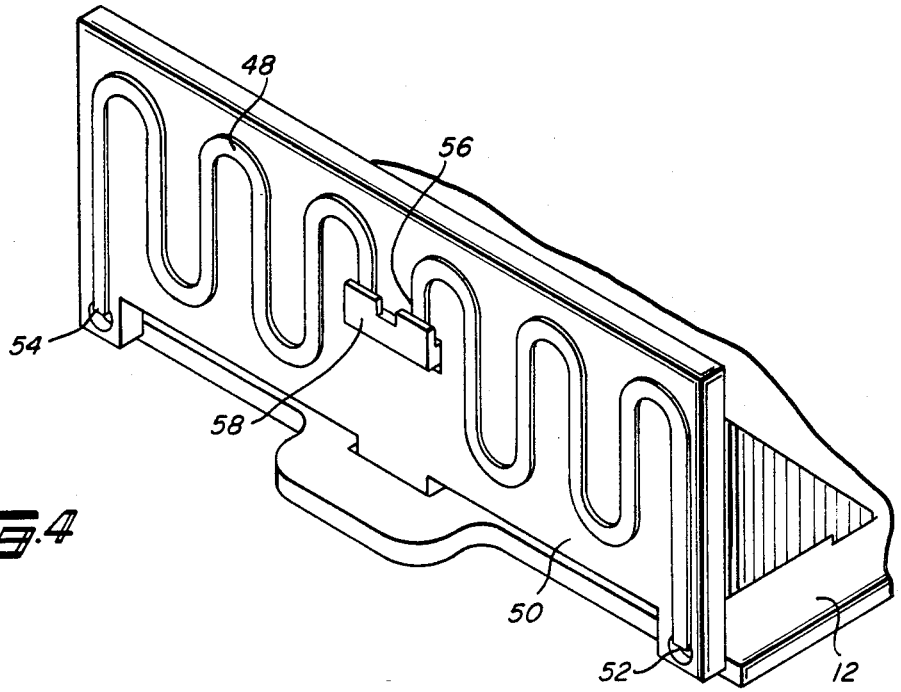
FIG. 4 is a partial perspective view of another preferred embodiment of a transceiver antenna conductor configuration in accordance with the present invention.

The pattern of the antenna is predetermined to allow for inductive loading. Other means for inductively loading the antenna such as with discrete inductors also are possible. Other printed circuit configurations, may also be used to inherently achieve this effect. For example, another preferred embodiment of conductor pattern is illustrated in FIG. 4. A conductor 48 is supported on a circuit board 50 which is connected to the elongated circuit board 12 in a substantially perpendicular fashion. First and second ends 52, 54 terminate the conductor 48 and are coupled to radiator elements 26, 28 (see FIG. 1). A feed point 56 is located substantially central of the conductor. The feed point 56 is coupled to one conducting plate 58 of a variable capacitor which extends through the circuit board 50.

Figure 5:
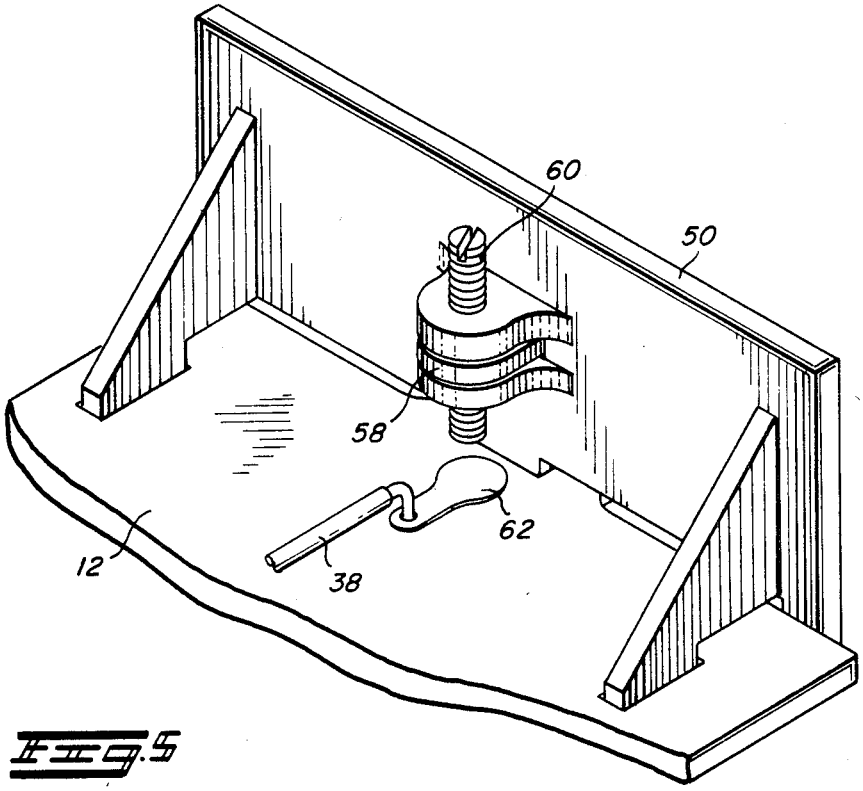
FIG. 5 is a partial perspective view of the reverse side of the embodiment illustrated in FIG. 4.

Referring to FIG. 5, which is the back view of FIG. 4, the conducting plate 58 engages a conducting screw 60. A second conducting plate 62 is attached to the elongated circuit board 12. The screw 60 may be turned to adjust the distance between the end of the screw and the second conducting plate 62, thus varying the capacitance. The second conducting plate 62 is connected to the input transmission line 38.

EXAMPLE

An embodiment of a 900 MHz antenna using a pair of 1 MHz frequency bands centered at 915 and 960 MHz was constructed according to the present invention. The following dimensions were found to be satisfactory and produce acceptable transmission and reception quality. These dimensions are only exemplary and do not limit the scope of the invention.

The total length of the copper conductor was approximately 4.25 inches (10.8 cm), the width of the conductor strip was approximately 0.1 inches (0.25 cm) and the thickness of the strip was approximately 0.002 inches (0.005 cm). The width of each leg of the serpentine configuration seen in FIG. 1 was approximately 0.6 inches (01.52 cm). Each of the radiator elements was about 0.6 inches (1.52 cm) in length. The variable capacitor was made of two plates which were separated by the same dielectric material which carried the conductor pattern. The capacitance of the variable capacitor in the high impedance circuit was 0.1 to 0.5 pfd. The conductor pattern was made by placing the copper strips onto a dielectric material. The variable capacitor was adjusted by bending one of the two plates to change the position of the plates relative to one another in accordance with the resonance frequencies of the antenna. This adjustment may take place after assembly and access to the variable capacitor from outside of the housing may be available.

The one-quarter wavelength transmission line stub had a length of approximately one inch (2.5 cm), a width of 7/16 inches (1.1 cm), and a thickness of 0.010 inches (0.025 cm) with an $\epsilon_r$ of 10 and a $Z_0$ of 5 ohms. The transmission line stub was adjusted prior to its incorporation in the transceiver and was tuned to the geometric mean of the two frequency bands.

The radiation pattern of the constructed antenna was reasonably omnidirectional and the overall performance was excellent.

The present invention therefore provides a new and improved dual band antenna for use in radio wave transceiver duplex applications where the antenna must be compact and yet not be affected during use by the operator's person. The present invention also demonstrates inductively loading an antenna so that it may be of compact size and yet promote high efficiency.

The antenna of the present invention is also easily manufactured or fabricated using printed circuit techniques to produce the conductive pattern of the antenna. Such an antenna is easily adjusted for optimum performance by using an economical variable capacitor.

An antenna produced in accordance with the present invention maintains a high impedance field in the center of the antenna. Thus, the high impedance portion of the antenna is protected in the center of an elongated circuit board or housing of a radio transceiver to minimize the detrimental effect that an operator can have upon the radio's performance. The placement of the two radiators make it unlikely that the operator's hand could shield both. The invention also provides a high Q parallel tuned circuit so that two frequency bands are created for the radio transceiver to use for duplex operation.

Modifications and variations of the present invention are possible in light of the above teachings. It is, therefore, to be understood that within the scope of the appended claims the invention may be practiced otherwise than as specifically described.

We claim:

1. A dual band transmission line antenna for a radio wave transceiver comprising:

a center portion of a fixed predetermined length for carrying an electrical signal, said center portion providing an inductive load and having first and second ends spaced apart;

a feed point located substantially central to said first and second ends of said center portion;

first and second radiator elements connected to said first and second ends respectively of said center portion:

a ground plane terminating said first and second radiator elements;

an adjustable impedance matching circuit coupled to said central feed point for balancing said antenna, and including a variable capacitor;

dual banding means for providing two frequency bands, and including a high Q circuit, parallel tuned at substantially the geometric mean of the center frequencies of the two bands, said dual banding means coupled to said impedance matching circuit; and input/output means coupled to said dual banding means.

2. The antenna defined in claim 1, wherein said parallel tuned circuit comprises a transmission line stub to provide reactances to match the input/output means' reactance at both bands.

3. The antenna defined in claim 1, wherein said variable capacitor comprises an adjustable air gap parallel plate device including a conducting screw, adjustable in relation to a conducting plate, whereby the screw adjustment tunes the antenna.

4. The antenna defined in claim 1, wherein the configuration of said center portion of said antenna has a serpentine pattern for inductively loading said antenna.

5. The antenna defined in claim 1, wherein said input/output means comprises an antenna duplexer.

6. The antenna defined in claim 1, wherein said center portion of said antenna is a printed pattern on a dielectric substrate.

7. The antenna defined in claim 1, wherein said two frequency bands of said dual banding means are separated by about one to eight percent of a center frequency.

* * * * *